US005098340A

United States Patent [19]

Abe

[11] Patent Number: 5,098,340

[45] Date of Patent: Mar. 24, 1992

[54] COIN FEEDER

[75] Inventor: Hiroshi Abe, Tokyo, Japan

[73] Assignee: Asahi Seiko Kabushiki Kaisha, Tokyo, Japan

[21] Appl. No.: 665,759

[22] Filed: Mar. 7, 1991

[30] Foreign Application Priority Data

Mar. 13, 1990 [JP] Japan ..... 2-59865

[51] Int. Cl.[5] ..... G07D 1/00

[52] U.S. Cl. ..... 453/57; 453/49

[58] Field of Search ..... 453/49, 57; 221/203; 198/659, 676

[56] References Cited

U.S. PATENT DOCUMENTS

| | | | |
|---|---|---|---|
| 3,933,162 | 1/1976 | Smith | 453/57 |
| 4,148,331 | 4/1979 | Nicolaus | 453/57 X |
| 4,192,418 | 3/1980 | Montgomery | 198/659 |
| 4,496,086 | 1/1985 | Duchadeau | 198/659 X |
| 4,557,101 | 12/1985 | Hesterberg | 453/49 X |
| 4,589,433 | 5/1986 | Abe . | |
| 4,615,350 | 10/1986 | Boudville | 453/57 |
| 4,902,263 | 2/1990 | Ito et al. | 453/49 |
| 5,000,718 | 3/1991 | Abe | 453/57 |
| 5,016,397 | 5/1991 | Higginbotham | 453/63 X |

FOREIGN PATENT DOCUMENTS

| | | | |
|---|---|---|---|
| 2616420 | 12/1988 | France | 198/659 |

*Primary Examiner*—Robert J. Spar
*Assistant Examiner*—Scott L. Lowe
*Attorney, Agent, or Firm*—Nilles & Nilles

[57] ABSTRACT

A coin feeder comprising a hopper for holding a supply of coins in bulk; a rotary disc rotatably disposed at an angle to the horizontal within the hopper and provided with a central circular stage and a plurality of coin transporting pins which are protruded from a peripheral portion around the central circular stage and spaced apart in the peripheral direction of the rotary disc; and an outlet including an outlet chute for guiding coins pushed out of the hopper by coin transporting pins. The central circular stage is provided with a brush having bristles of synthetic resin or another non-metallic material for cleaning coins within the hopper.

6 Claims, 3 Drawing Sheets

COIN FEEDER

BACKGROUND OF THE INVENTION

1. Field of the Invention

The present invention relates to a coin feeder of a hopper type usually used in vending machines, game machines, coin exchangers or the like for dispensing coins one at a time from a hopper having a plurality of coins in bulk.

2. Related Art Statement

Hitherto, such a coin feeder is well known as disclosed in U.S. Pat. No. 4,589,433 and comprises, as shown in FIG. 4, a hopper 1 for storing coins A to be dispensed in bulk and a rotary disc 2 disposed in the hopper 1 and rotatably supported on an inclined support plate by means of a bearing (not shown) to be rotated about a rotating shaft at an angle to the horizontal within the hopper 1. The rotary disc 2 has at its central portion a central circular stage 3 of a diameter depending on a diameter of a coin to be dispensed and at its peripheral portion a plurality of coin transporting projections or pins 4 spaced apart in the peripheral direction to define coin receiving spaces on an inclined surface of the rotary disc 2 between sequential feeding pins 4. When the rotary disc 2 is rotated, each coin feeding pin 4 picks up a coin into the respective coin receiving space from a gutter (not shown) formed between lower portions of the hopper 1 and the rotary disc 2 and delivers the coin to the upper delivery zone of the coin feeder. At the upper delivery zone, the coin feeder is provided with an outlet device which includes an outlet chute 5 for receiving and guiding each coin pushed out of the hopper by means of the respective coin feeding pin 4 along a delivery guide which traverses the peripheral portion of the rotary disc 2 in a direction tangential to the upper periphery of the central stage 3, and an upstanding coin transporting duct 6 connected at the lower end thereof to the outlet chute 5 and upwardly extended for transporting coins to a coin tray (not shown) at a desired elevated position.

Such a coin feeder is recently used in coin collecting and supplying lines of game machines such as a slot machine for transporting coins or medals from each of a plurality of game machines to a coin hopper through a coin collecting conveyor and from the coin hopper to each of the game machines through a coin supplying conveyor.

Such a coin feeder used in the coin collecting and supplying line is usually continuously operated.

SUMMARY OF THE INVENTION

An object of the present invention is to provide a coin feeder having a cleaning function particularly suitable for continuous operation in the coin collecting and supplying line as mentioned above. According to the present invention, in a coin feeder comprising a hopper for holding a supply of coins in bulk, a rotary disc rotatably disposed at an angle to the horizontal within the hopper and provided with a central circular stage and a plurality of coin transporting pins which are protruded from a peripheral portion around the central circular stage and spaced apart in the peripheral direction of the rotary disc, and outlet means including an outlet chute for guiding coins pushed out of the hopper by means of the coin transporting pins, the central circular stage is provided with a brush having bristles of synthetic resin or other nonmetallic material.

In a preferred embodiment of the present invention, the brush includes a plate shaped holder having a plurality of bristle holding arms radially extending from the center thereof and bristles built in each of the bristle holding arms. The length of the bristles may be different from each other in the radial direction of the bristle holding arms.

Furthermore, the outlet means may include a coin transporting duct horizontally or vertically extending for transporting coins from the outlet chute. The coin transporting duct may include a pipe, a rotating central shaft extended through the pipe, a helical brush helically secured around the central shaft and means for driving the rotating central shaft.

DESCRIPTION OF THE PREFERRED EMBODIMENT

The invention will be described in more detail in the following with reference to the accompanying drawings.

Figure 1:
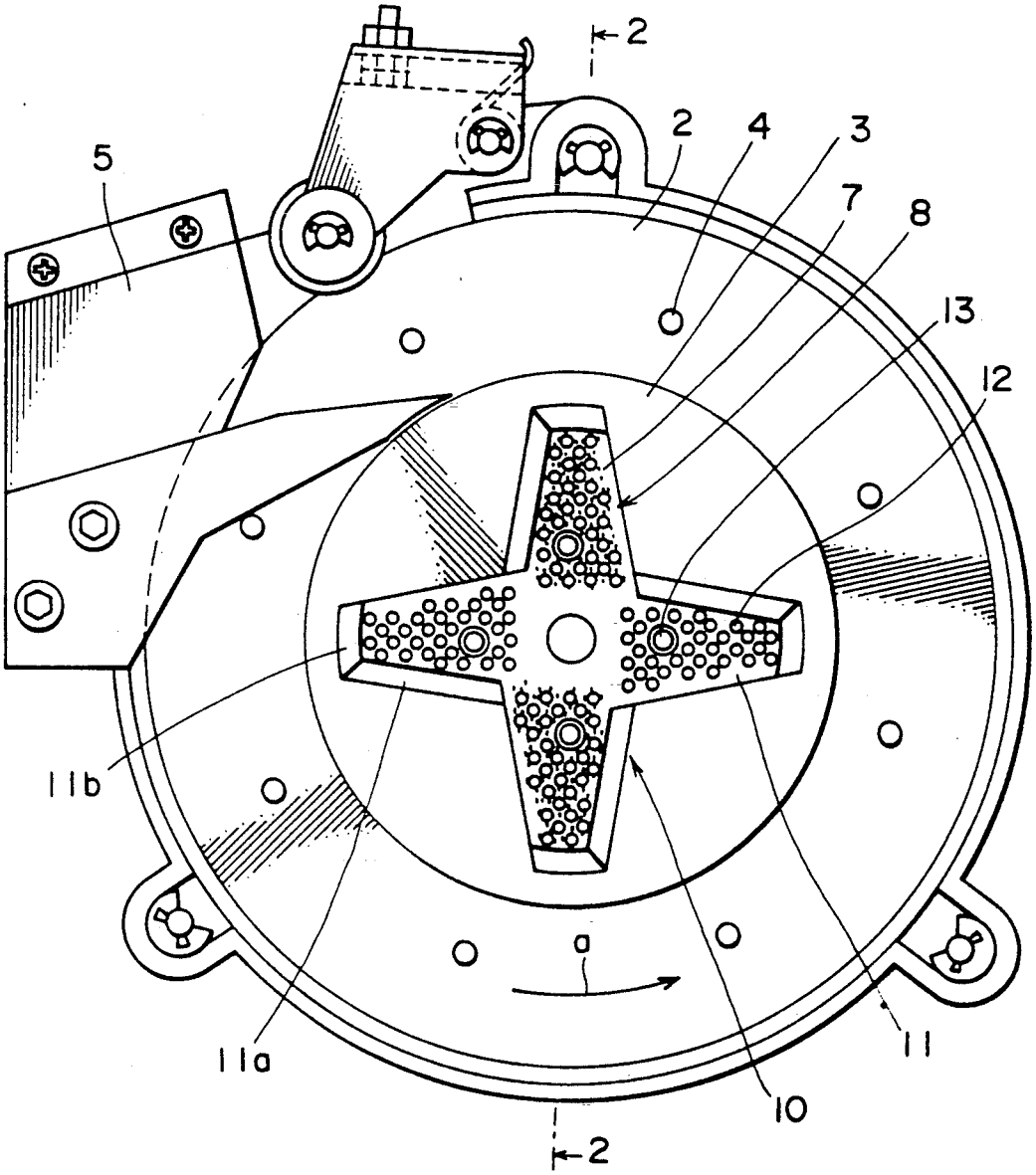
FIG. 1 is a schematic view illustrating an embodiment of the rotary disc according to the present invention.
Figure 2:
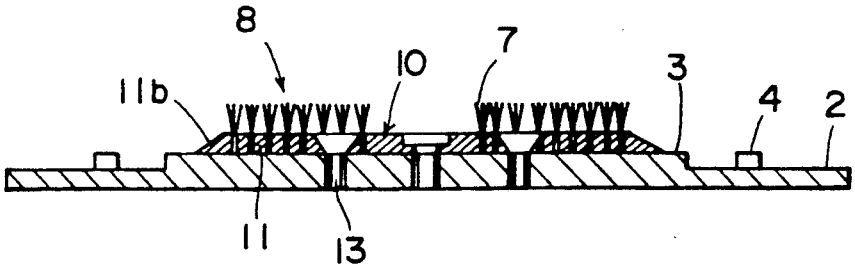
FIG. 2 is a sectional view taken along a line 2—2 in FIG. 1.

Referring to FIG. 1 illustrating a rotary disc 2 and its peripheral parts of a coin feeder, the rotary disc 2 has a central circular stage 3 and a plurality of coin transporting pins 4 which are protruded from a peripheral portion around the central circular stage 3. The central circular stage 3 is provided with a bristle brush 8. The bristle brush 8 includes a plate shaped holder 10 which is made of synthetic resin and has four bristle holding arms 11 radially extending from the center portion of the holder. The bristle holding arms 11 have a plurality of bristle built-in holes 12, into each of which several nylon bristles 7 are fitted in a conventional manner as in the art of toothed brushes. The length of the bristles may be an order of 10 mm. Each bristle holding arm 11 is slanted at the front side **11*a* with respect to the rotational direction a of the rotary disc 2 and at the tip end 11*b* to prevent coins from riding on the front side 11*a* and the tip end 11*b* when the rotary disc is rotated, otherwise coins will be pushed upward to cause troubles in operation of the coin feeder. The holder 10 with built-in bristles 8 is replaceably attached to the top surface of the central stage 3 by means of screws 13**.

Figure 3:
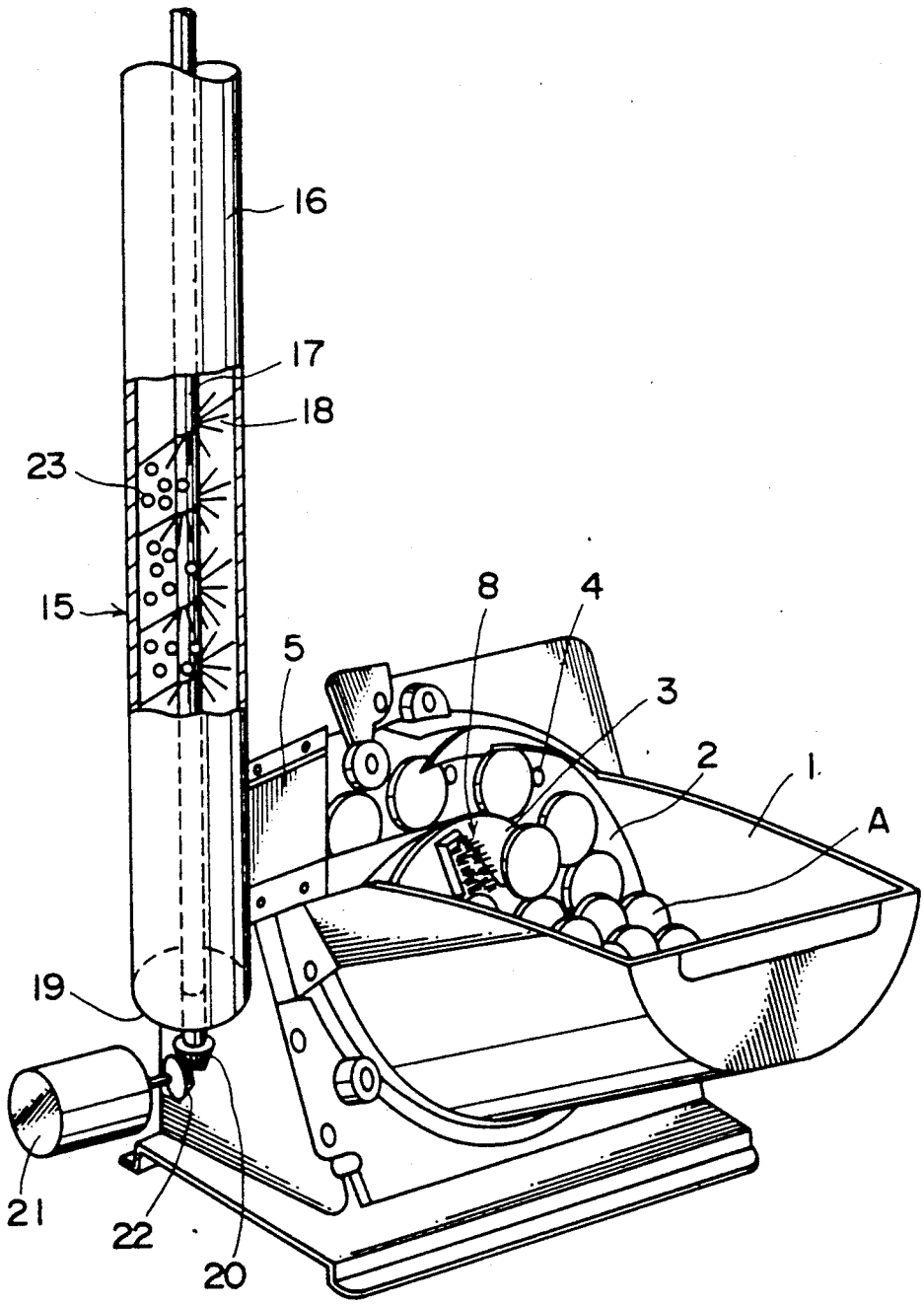
FIG. 3 is a perspective view of an embodiment of the coin feeder with a coin transporting duct according to the present invention.
Figure 4:
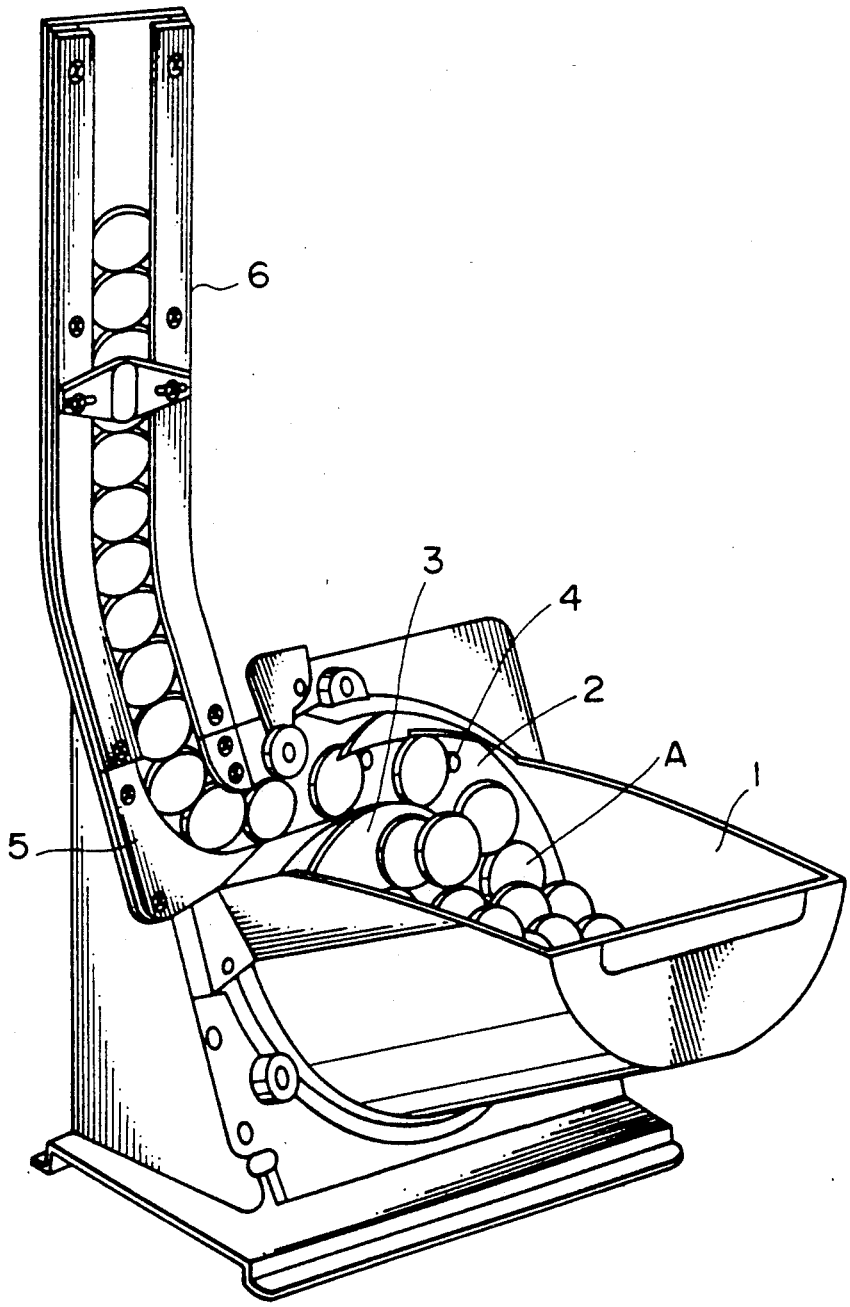
F I G . 4 PRIOR ART
FIG. 4 is a perspective view of a conventional coin feeder with a coin transporting duct of prior art.

FIG. 3 shows an embodiment of a cleaning type coin transporting duct 15 connected to an outlet chute 5 of the coin feeder provided with the rotary disc 2 having the brush as mentioned above.

The cleaning type coin transporting duct 15 includes a pipe 16 connected at the lower inlet (not shown) thereof to an outlet of the outlet chute 5 so as to receive coins therefrom. The cylindrical pipe 16 is provided with a central rotating shaft 17 which is extended through the pipe 16 and has a helical brush 18 with bristles being helically secured around the central rotating shaft 17 in the form of a feed screw. The central rotating shaft 17 is extended through a bottom plate 19 of the pipe 16 and is provided at the extended lower end with a bevel gear 20 which is engaged a cooperating bevel gear 22 on an output shaft of an electric motor 21. The pipe 16 may be partially filled with abradant balls 23 such as Polylon (trade name).

With the arrangement mentioned above, under continuous operation of the coin feeder, coins A in the hopper 1 are pushed into the outlet chute 5 by the coin transporting pins 4 on the rotary disc 2 which is continuously rotated. During the operation of the coin feeder, coins in the hopper 1 are cleaned up by removing contaminants from the surface of coins and simultaneously agitated by means of the brushes 8 radially arranged on the central stage 3.

Coins A are fed from the outlet of the chute 5 into the lower portion of the up-standing pipe 16 of the coin transporting duct 15 and transported upwardly by rotation of the helical brush 18 in the pipe 16. During transporting, coins A are further cleaned up by means of abradant balls 23.

What is claimed is:

1. A coin feeder comprising a hopper for holding a supply of coins in bulk;

a rotary disc rotatably disposed at an angle to the horizontal within the hopper and provided with a central circular stage and a plurality of coin transporting pins which are protruded from a peripheral portion around the central circular stage and spaced apart in the peripheral direction of the rotary disc; and outlet means including an outlet chute for guiding coins pushed out of the hopper by means of the coin transporting pins;

the central circular stage being provided with a brush having bristles of non-metallic material.

2. The apparatus claimed in claim 1, wherein the brush includes a plate shaped holder having a plurality of bristle holding arms radially extending from the center thereof and bristles built in each of the bristle holding arms.

3. The apparatus claimed in claim 2, wherein the length of the bristles is different from each other in the radial direction of the bristle holding arms.

4. The apparatus claimed in claim 1, wherein the outlet means includes a coin transporting duct connected to an outlet of the outlet chute for receiving and transporting coins from the outlet chute.

5. The apparatus claimed in claim 1, wherein the coin transporting duct includes a pipe, a rotating central shaft extended through the pipe, a helical brush helically secured around the rotating central shaft and means for driving the rotating central shaft.

6. A coin-feeder as set forth in claim 1, further characterized in that said non-metallic material is a synthetic material.

* * * * *